US008826949B2

(12) United States Patent
Kent

(10) Patent No.: US 8,826,949 B2
(45) Date of Patent: Sep. 9, 2014

(54) CANNING FUNNEL

(71) Applicant: Progressive International Corporation, Kent, WA (US)

(72) Inventor: Joseph Kent, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 13/754,586

(22) Filed: Jan. 30, 2013

(65) Prior Publication Data

US 2013/0199667 A1 Aug. 8, 2013

Related U.S. Application Data

(60) Provisional application No. 61/596,495, filed on Feb. 8, 2012.

(51) Int. Cl.

| | |
|---|---|
| ***B65B 39/00*** | (2006.01) |
| ***B67C 11/02*** | (2006.01) |
| *B67C 11/00* | (2006.01) |

(52) U.S. Cl.

CPC ..... *B67C 11/02* (2013.01); *B67C 2011/40* (2013.01); *B65B 39/00* (2013.01)

USPC ..... 141/342; 141/340; 141/341

(58) Field of Classification Search

CPC ..... B67C 11/02; B65B 39/00; B65B 39/007

USPC ..... 141/331–332, 339–343

See application file for complete search history.

(56) References Cited

U.S. PATENT DOCUMENTS

| | | | | | |
|---|---|---|---|---|---|
| 100,851 | A | * | 3/1870 | Brundage et al. | 141/340 |
| 160,017 | A | * | 2/1875 | Hoagland | 141/335 |
| 194,887 | A | * | 9/1877 | Berg | 141/344 |
| 298,504 | A | * | 5/1884 | Robinson | 141/94 |
| 299,513 | A | | 6/1884 | Bolton | |
| 475,874 | A | * | 5/1892 | Leggett | 141/340 |
| 790,463 | A | * | 5/1905 | Taliaferro | 73/294 |
| 1,368,640 | A | * | 2/1921 | Melchior | 141/340 |
| 2,703,670 | A | | 3/1955 | Voight | |
| 2,767,744 | A | * | 10/1956 | Beerman | 141/319 |
| D250,804 | S | * | 1/1979 | Nilsson | D7/400 |
| 4,334,557 | A | * | 6/1982 | YaSenka | 141/98 |
| 4,804,026 | A | * | 2/1989 | Bailey | 141/340 |
| 4,976,297 | A | | 12/1990 | Peckels | |
| 5,762,120 | A | | 6/1998 | Smith | |
| 5,927,353 | A | * | 7/1999 | Persson et al. | 141/340 |
| 6,035,907 | A | * | 3/2000 | DeCoster | 141/331 |
| D669,751 | S | | 10/2012 | Kent | |
| 8,393,361 | B2 | * | 3/2013 | Luchinger et al. | 141/83 |
| 2011/0308667 | A1 | | 12/2011 | Gallegos | |

* cited by examiner

*Primary Examiner* — Timothy L Maust

(74) *Attorney, Agent, or Firm* — Lowe Graham Jones PLLC

(57) ABSTRACT

A canning funnel includes an upper bowl that tapers downward to form a relatively narrower neck to direct the food items into a jar. A lower skirt surrounds the neck, forming a seat between the skirt and the neck. The skirt includes a cutaway portion with markings to allow a user to see headspace remaining in the jar.

14 Claims, 2 Drawing Sheets

CANNING FUNNEL

PRIORITY CLAIM

This application claims the benefit of provisional application Ser. No. 61/596,495 filed Feb. 8, 2012, the contents of which are incorporated by reference.

FIELD OF THE INVENTION

This application is generally related to funnels, particularly including funnels for use in canning fruits and vegetables.

BACKGROUND OF THE INVENTION

Pouring foods into jars during a home canning process generally requires the use of a funnel. Most preferably, the funnel has a wide mouth and allows the food items to be directed into the jar. One example of such a funnel designed specifically for canning is described in U.S. Pat. No. 5,762,120 to Smith. The '120 patent uses a lower threaded portion that is intended to engage the threads on the mouth of a jar to attach the funnel to the jar. This configuration allows the funnel to securely rest atop the jar so that the user need not hold the funnel in place, but the funnel carries certain disadvantages as well. While the funnel of the '120 patent may work somewhat well in use with jars that are sized to perfectly fit the threaded neck of the funnel, it does not accommodate jars of a variety of sizes and has other drawbacks making it less than ideal.

SUMMARY OF THE INVENTION

The present invention relates to a funnel particularly well suited for filling canning jars. In a preferred example of the invention, the funnel includes an upper bowl that tapers downward to form a relatively narrower neck to direct the food items into the jar. A lower skirt surrounds the neck, forming a seat between the skirt and the neck. In use, the seat of the funnel rests atop the rim of the jar in order to support the funnel in place over the jar.

In accordance with some preferred versions of the invention, the skirt includes one or more cutaway portions or otherwise does not extend fully around the neck of the funnel. The cutaway portion allows a user to see the extent to which the jar is full, and likewise the amount of headroom remaining in the jar to determine whether it is filled to an ideal level without needing to remove the funnel for this purpose.

In some versions of the invention, the seat defines a distance between the neck and the skirt, such that the seat can accommodate jars having a variety of mouth sizes. In such versions, the skirt provides stability for the funnel atop the jar while still accommodating jars of multiple sizes.

In preferred examples, the skirt includes distance markings along an edge adjacent the cutaway portion to allow a user to readily determine the amount of headroom, or the distance between the rim of the jar and the top of the food placed in the jar.

The neck preferably includes a downwardly extending lip that extends below the level of the seat, and therefore is positioned below the rim of the jar when the funnel is placed atop the jar.

In some versions, the funnel may include a handle, preferably formed as a ring shaped to accommodate a finger of a user.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
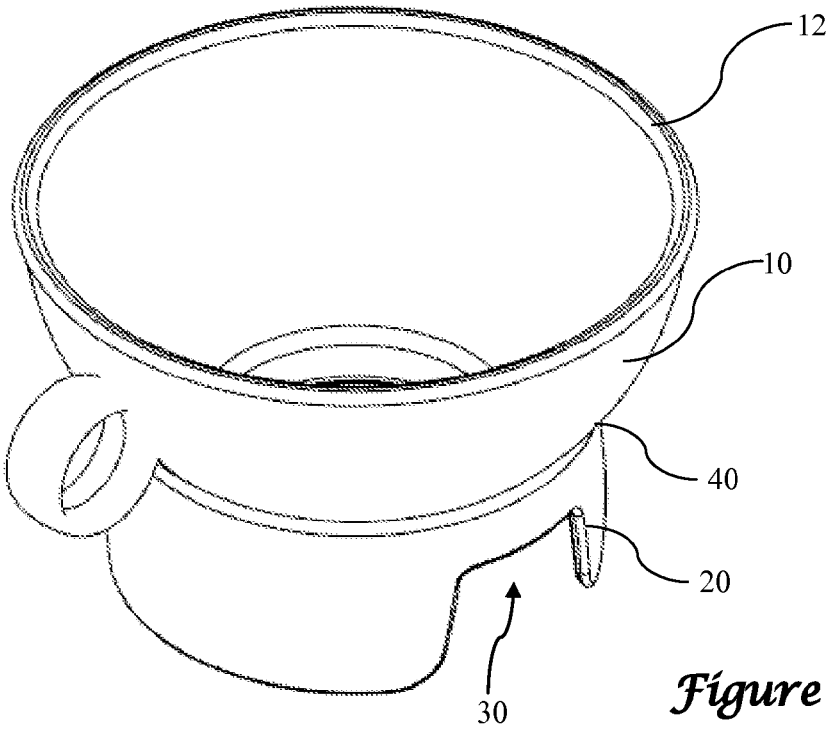
FIG. 1 is a top perspective view of a preferred canning funnel.

A preferred canning funnel as illustrated in each of FIGS. 1-4 includes an upper bowl 10 secured to a lower skirt 20. The bowl includes a rim 12 at the top, and in the version as shown the rim is generally circular as viewed from the top. The bowl is formed from sidewalls that taper inward and downward from the rim 12 to a neck 40, with the neck preferably being located generally in the vicinity where the bowl 10 transitions to the skirt 20. The neck 40 in the illustrated version is also circular and defines a circular opening 45, with the neck having a diameter that is smaller than that of the rim.

A handle 14 is optionally attached to an outer portion of the bowl 10, and in the illustrated version the handle is in the form of a ring sized to accommodate one or more fingers of a user. The handle may alternatively be formed as a flange or stem extending laterally away from the bowl, and most preferably the handle is relatively small in order to avoid weight sufficient to topple the funnel when it rests atop a jar.

Figure 2:
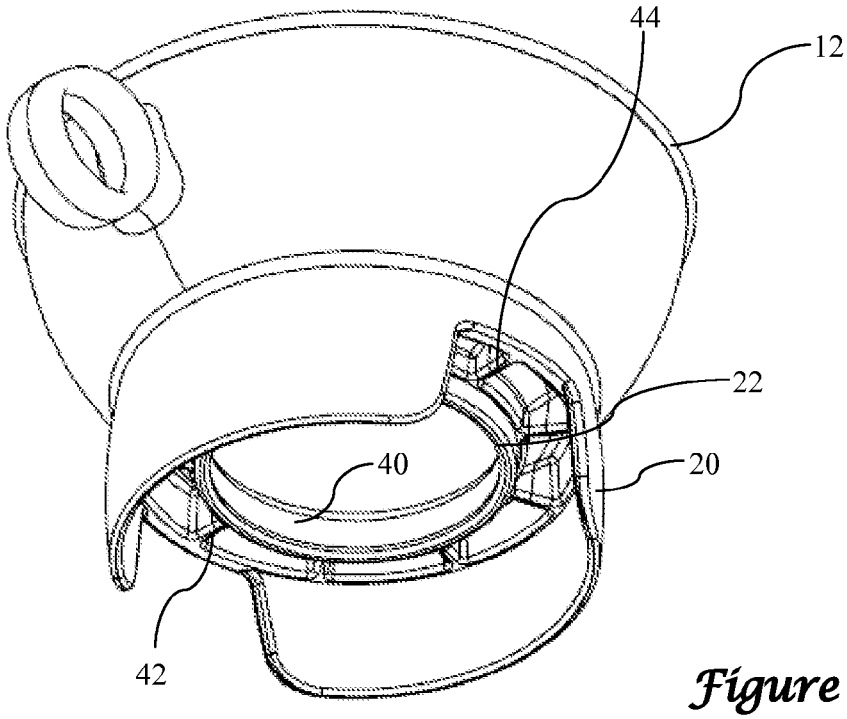
FIG. 2 is a bottom perspective view of a preferred canning funnel.
Figure 4:
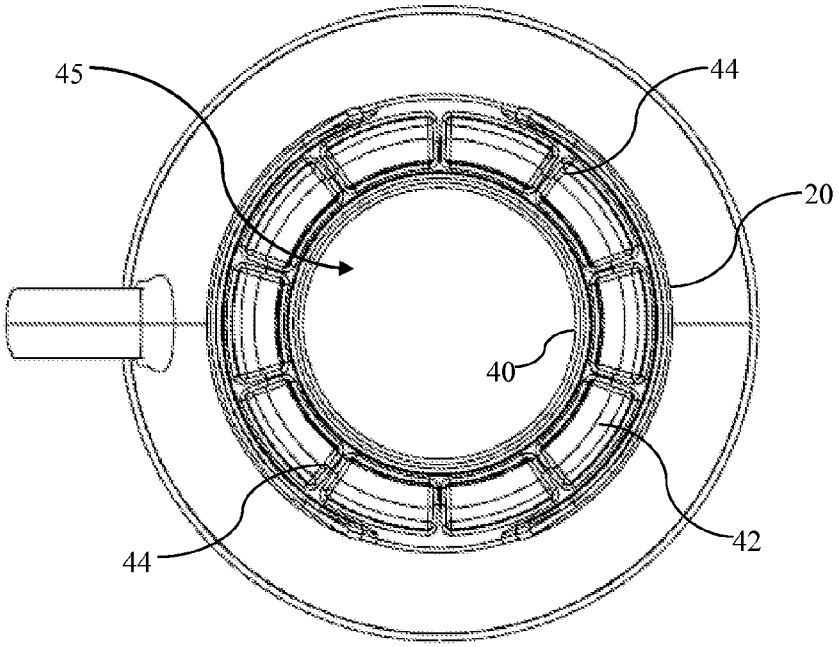
FIG. 4 is a bottom view of a preferred canning funnel.

A lower portion of the bowl 10, adjacent the neck 40 of the funnel, forms a seat 42 as best seen in FIG. 2. As viewed from the bottom, the seat 42 is generally defined between the neck 40 and the skirt 20, as best seen in FIG. 4. In the illustrated version the seat is substantially flat, defining a plane that is parallel to a plane defined by the rim of the bowl. The seat therefore provides a surface that engages the top of a jar, allowing the seat to rest atop the jar.

As shown, the seat is further formed with a plurality of ribs 44 extending radially outward from the neck and spaced evenly about the annular seat. The ribs provide structural support for the seat and further provide a surface for engaging the top of a jar. The length of the ribs define a radial distance between the neck and the skirt, and therefore a width of the annular seat. As a result, the funnel is able to accommodate jars having a diameter ranging between the width of the neck and the width of the skirt. In the illustrated version as described above the seat is formed by a plurality of ribs having open or recessed areas between them. In other versions, the seat may form a continuous planar annular surface, and therefore without having open areas between ribs.

The skirt includes one or more cutouts 30 (as seen for example in FIG. 3), and in the preferred version it includes a pair of cutouts positioned diametrically opposite one another. In the illustrated example, each of the pair of cutouts defines a distance along the perimeter of the skirt that is less than one quarter of the perimeter, and more preferably each cutout is less than one eighth of the perimeter of the skirt. This preferred size of the cutout allows for ample space to see the headroom of the jar while providing a relatively large skirt area for stability of the funnel atop the jar.

In a preferred version as illustrated, the skirt includes interior wall surfaces that are not threaded. As shown, the seat is formed with a width to accommodate jars of a variety of widths, and therefore the skirt is not threadably secured to the jar. In order to improve stability of the canning funnel atop the jar, the skirt preferably extends downward along the jar far enough to engage the sidewalls of the jar (below the threaded neck of the jar) and to provide a larger engagement surface for the skirt against the jar. Accordingly, in preferred versions the skirt extends downwardly more than one inch below the seat, and may extend downwardly two inches or more.

When the funnel rests atop a jar, the cutout provides an area in which the top of the jar is not covered by the skirt, thereby allowing a user to see the top of the jar through the cutout. Accordingly, in the preferred version the cutout extends all the way upward to the plane defined by the seat, allowing the user to see the uppermost portion of the rim of the jar through the cutout. When filling a jar, the user is thereby able to readily see the amount of space remaining in the jar and not yet filled with the food items.

Figure 3:
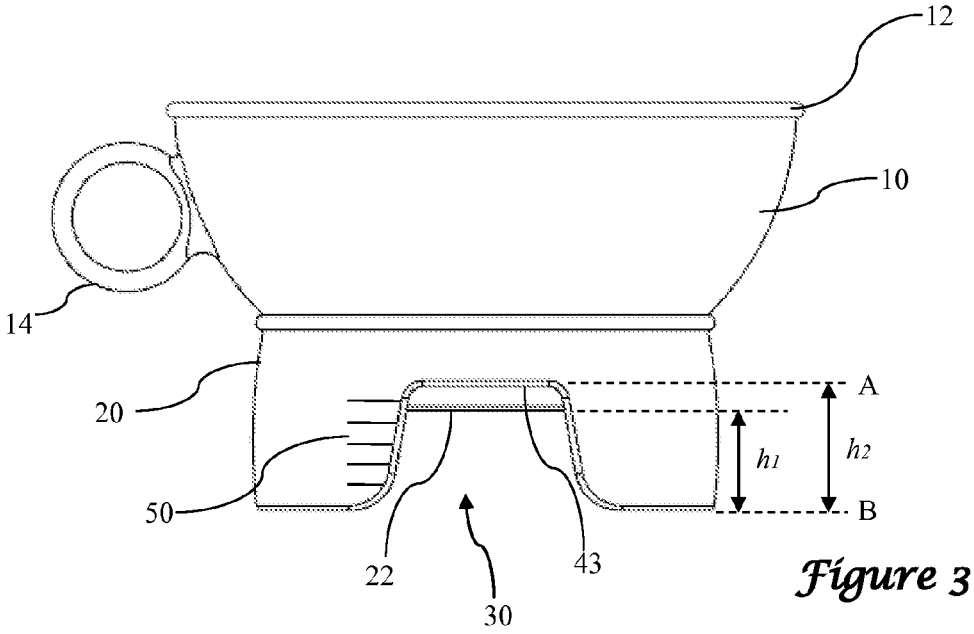
FIG. 3 is a front view of a preferred canning funnel.

A portion of the neck 40 extends downward, below the plane defined by the seat. As such, when the funnel is in position atop a jar a portion of the neck extends downward into the jar, below the upper rim of the jar. As best seen in FIGS. 2 and 3, in the preferred version the cutout 30 includes an upper edge 43 that is in the same plane as the plane defined by the seat, such that the upper edge 43 of the cutaway portion 30 terminates at a height $h_2$ above the lower edge of the skirt. The lower lip 22 of the neck 40 extends downward from the plane of the seat, such that it is positioned at a distance $h_1$ above the lower edge of the skirt. In the preferred version the lower lip 22 of the neck 40 extends downward about 20 percent of the length of the cutout.

In an optional version of the invention, volume or distance markings 50 are provided along a portion of the skirt to indicate an amount of space between a particular marking and the plane defining the seat. In other words, the markings indicate a distance from line A in FIG. 3 (representing the plane of the seat) to line B in FIG. 3 (representing the lower edge of the skirt. Because the rim of the jar will terminate at the plane of the seat, the markings thereby define the distance between the marking and the top of the jar so that the user can readily determine whether a sufficient amount of space remains in the jar before sealing it with a lid. In the illustrated version, the markings are placed adjacent the cutout so that they are readily aligned with the surface of the food items filling the jar.

In use, the funnel is placed atop a jar with a mouth having a width between that of the neck and the skirt. The seat of the funnel rests atop the jar, providing a larger rim at the top to funnel items into the jar. The lower lip of the neck extends at least partially below the top of the jar in the preferred version to ensure that liquids do not run down the outside of the jar.

Food items are then poured into the funnel so that they will continue into the jar until the jar is filled to a desired level. If desired, the user can look through the cutout to determine the amount of space remaining in the jar, comparing the top surface of the food in the jar against the distance markings on the skirt to ensure a desired amount of empty space remains. Once filled, the funnel is removed and the jar is sealed.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A canning funnel, comprising:

a bowl having sidewalls extending upwardly from a neck to an upper rim of the bowl, the upper rim of the bowl having a diameter greater than a diameter of the neck of the bowl, the neck defining an opening whereby food items placed in the upper bowl are funneled downward by the sidewalls and pass through the neck;

an annular seat formed about the opening of the neck, the annular seat defining a lower surface for supporting the canning funnel atop a canning jar;

a lower skirt extending downward from the canning funnel below the lower surface of the annular seat and in a direction away from the upper rim of the upper bowl, the lower skirt terminating in a lower edge;

the annular seat lower surface further comprising a planar annular surface extending radially outwardly from the opening of the neck to the lower skirt; and a cutaway portion formed in the lower skirt, whereby an upper portion of the canning jar is visible through the cutaway portion when the seat of the canning funnel is supported atop the canning jar.

2. The canning funnel of claim 1, wherein the cutaway portion comprises a first cutaway portion and a second cutaway portion, the first cutaway portion and the second cutaway portion being positioned diametrically opposite from each other.

3. The canning funnel of claim 1, further comprising one or more distance markings positioned on the skirt adjacent the cutaway portion, the one or more distance markings representing one or more distances along the skirt below the lower surface of the seat.

4. The canning funnel of claim 1, wherein the neck further comprises a lower lip, the lower lip extending downward from the neck in a direction away from the upper rim of the bowl and terminating below a plane defined by the seat, the lower lip further extending around the entire perimeter of the neck.

5. The canning funnel of claim 1, wherein the seat comprises a plurality of ribs extending radially outward from the neck to the skirt.

6. The canning funnel of claim 1 wherein the cutaway portion further comprises an upper edge defining a top of an opening formed by the cutaway portion, the upper edge being positioned in a plane defined by the lower surface of the seat.

7. The canning funnel of claim 1, further comprising a handle extending laterally away from the bowl.

8. The canning funnel of claim 1, wherein the opening defined by the neck is circular.

9. The canning funnel of claim 1, wherein the cutaway portion is formed in less than one quarter of the skirt.

10. The canning funnel of claim 1, wherein the skirt extends downwardly more than one inch below the seat.

11. The canning funnel of claim 1, wherein the skirt extends downwardly more than two inches below the seat.

12. A canning funnel, comprising:

a bowl having sidewalls extending upwardly from a neck to an upper rim of the bowl to define a vertical height between the neck and the upper rim, the upper rim of the bowl having a diameter greater than a diameter of the neck of the bowl, the neck defining an opening whereby food items placed in the upper bowl are funneled downward by the sidewalls and pass through the neck;

a lower skirt extending downward from the canning funnel below the neck and in a direction away from the upper rim of the upper bowl, the lower skirt terminating in a lower edge positioned at a vertical distance below the neck;

an annular seat formed about the opening of the neck and defining an annular horizontal surface extending radially outwardly from the opening of the neck to the lower skirt, the annular seat defining a lower surface for supporting the canning funnel atop a canning jar;

a cutaway portion formed in the lower skirt, the cutaway portion having an upper edge defining a top of an opening formed by the cutaway portion, the upper edge being positioned in a plane defined by the lower surface of the seat, whereby an upper portion of the canning jar is visible through the cutaway portion when the seat of the canning funnel is supported atop the canning jar.

13. The canning funnel of claim 12, further comprising one or more distance markings positioned on the skirt adjacent the cutaway portion, the one or more distance markings representing one or more distances between the horizontal lower surface of the seat and one or more locations along the skirt below the lower surface of the seat.

14. The canning funnel of claim 12, wherein the neck further comprises a lower lip, the lower lip extending downward from the neck in a direction away from the upper rim of the bowl and terminating below a plane defined by the seat, the lower lip further extending around the entire perimeter of the neck.

* * * * *